US010364064B2

(12) United States Patent
McCarthy et al.

(10) Patent No.: US 10,364,064 B2
(45) Date of Patent: Jul. 30, 2019

(54) PALLET WITH SKIRT

(71) Applicant: Menasha Corporation, Neenah, WI (US)

(72) Inventors: Thomas W. McCarthy, Pittsburgh, PA (US); Brad L. Clark, North Huntingdon, PA (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 15/902,021

(22) Filed: Feb. 22, 2018

(65) Prior Publication Data

US 2018/0244431 A1 Aug. 30, 2018

Related U.S. Application Data

(60) Provisional application No. 62/461,916, filed on Feb. 22, 2017.

(51) Int. Cl.
*B65D 19/38* (2006.01)
*B65D 61/00* (2006.01)

(52) U.S. Cl.
CPC ..... *B65D 19/385* (2013.01); *B65D 61/00* (2013.01); *B65D 2519/0096* (2013.01); *B65D 2519/00273* (2013.01); *B65D 2519/00293* (2013.01); *B65D 2519/00323* (2013.01); *B65D 2519/00333* (2013.01); *B65D 2519/00373* (2013.01); *B65D 2571/00037* (2013.01)

(58) Field of Classification Search
CPC ..... B65D 19/385; B65D 61/00; B65D 2571/00037
USPC ..... 108/51.3, 51.11, 55.1, 53.1, 53.3, 53.5, 108/56.1; 206/600, 386, 597
See application file for complete search history.

(56) References Cited

U.S. PATENT DOCUMENTS 2,810,474 A * 10/1957 Essick ..... B65D 5/5206 206/736
3,055,573 A 9/1962 Carter
4,738,371 A * 4/1988 Wakeman ..... B65D 19/06 217/43 A
4,877,137 A * 10/1989 Govang ..... B65D 5/12 206/597
4,927,026 A * 5/1990 Gossler ..... B65D 19/20 108/56.1
5,110,037 A * 5/1992 Pieritz, Sr. ..... B65D 5/68 206/386
5,251,753 A * 10/1993 Pigott ..... B65D 71/0096 206/586
5,318,219 A * 6/1994 Smith ..... B65D 19/06 206/386
5,542,541 A * 8/1996 Smith ..... B65D 19/20 206/600
RE35,875 E * 8/1998 Shuert ..... 108/55.1
5,826,721 A * 10/1998 Fujimoto ..... B65D 19/16 206/389

(Continued)

*Primary Examiner* — Jose V Chen
(74) *Attorney, Agent, or Firm* — Greensfelder, Hemker & Gale, P.C.

(57) ABSTRACT

A skirt system for use with a pallet carrying goods is provided. The skirt system includes a rectangular support pad that is positioned on a stack of pallets and a skirt having a rectangular opening. The skirt interacts with features on the support pad for quick and easy set up. The skirt covers the stack of pallets which supports goods and provides a visually pleasing display for such goods.

21 Claims, 7 Drawing Sheets

(56) References Cited

U.S. PATENT DOCUMENTS

| | | | | |
|---|---|---|---|---|
| 5,839,650 | A | 11/1998 | Sheffer | |
| 5,992,735 | A | 11/1999 | Oosterbaan | |
| 6,050,410 | A * | 4/2000 | Quirion | B65D 19/20 206/386 |
| 6,267,255 | B1 * | 7/2001 | Brush | A47F 5/112 206/386 |
| 6,513,705 | B1 | 2/2003 | Sheffer | |
| 6,612,441 | B2 * | 9/2003 | Lang | B65D 19/20 206/600 |
| 6,868,968 | B1 | 3/2005 | Casanovas | |
| 7,066,342 | B2 | 6/2006 | Baechle et al. | |
| 7,273,149 | B2 | 9/2007 | Lutes et al. | |
| 7,637,372 | B2 | 12/2009 | Keel et al. | |
| 7,861,865 | B2 * | 1/2011 | Green | B65D 19/06 206/386 |
| 8,056,727 | B1 * | 11/2011 | Marsh | B65D 19/38 108/56.3 |
| 8,317,039 | B2 | 11/2012 | Norman | |
| 8,424,681 | B1 * | 4/2013 | Schonhardt | B65D 85/46 206/198 |
| 8,833,573 | B2 | 9/2014 | Tomaszewski et al. | |
| 9,138,079 | B2 | 9/2015 | Su | |
| 9,278,779 | B2 * | 3/2016 | Funaki | B65D 19/385 |
| 9,428,298 | B2 | 8/2016 | Bersamin et al. | |
| 9,475,608 | B2 * | 10/2016 | Dye | B65D 19/44 |
| 9,580,201 | B2 | 2/2017 | Willman et al. | |
| 9,783,333 | B1 | 10/2017 | De Los Santos et al. | |
| 9,826,843 | B1 | 11/2017 | Tomaszewski et al. | |
| 9,908,663 | B1 * | 3/2018 | Valentini | B65D 19/38 |
| 9,918,569 | B1 | 3/2018 | Abel | |
| 9,938,040 | B2 | 4/2018 | Buscema | |
| 2005/0023168 | A1 * | 2/2005 | Marnocha | B65D 5/445 206/386 |
| 2007/0227936 | A1 * | 10/2007 | Youell, Jr. | B65D 19/20 206/600 |
| 2009/0032432 | A1 | 2/2009 | Kostos et al. | |
| 2016/0368660 | A1 | 12/2016 | Pfeifer et al. | |
| 2017/0267398 | A1 | 9/2017 | Couture | |
| 2017/0267399 | A1 | 9/2017 | Buscema | |
| 2017/0305593 | A1 | 10/2017 | Couture | |
| 2018/0092461 | A1 | 4/2018 | Brady et al. | |
| 2018/0146803 | A1 | 5/2018 | Urban | |
| 2018/0160825 | A1 | 6/2018 | Abel | |
| 2018/0168367 | A1 | 6/2018 | Kistner | |
| 2018/0168368 | A1 | 6/2018 | Kistner | |
| 2018/0170608 | A1 | 6/2018 | Adams | |
| 2019/0008290 | A1 | 1/2019 | Ertl | |

* cited by examiner

PALLET WITH SKIRT

CROSS-REFERENCE TO RELATED APPLICATIONS

The present invention claims the benefit of U.S. Provisional Patent Application No. 62/461,916 filed Feb. 22, 2017, the contents of which are incorporated herein by reference.

FEDERALLY SPONSORED RESEARCH OR DEVELOPMENT

N/A

FIELD OF THE INVENTION

The present invention is directed to a pallet display with a skirt having pockets or rollover portions that catch on protrusions or flanges from a support pad, mat or tray that supports goods on a stack of pallets.

DESCRIPTION OF THE PRIOR ART

A number of stores (such as big box stores or discount club stores) display goods or other similar product items directly on a pallet used to transport the goods. This can save time and money in that the goods do not need to be transferred to a separate display. To place the goods at a preferred height for display to shoppers, the transport pallet is typically placed on one or more other pallets, or other structures. A skirt (typically having graphics or other visual artistic elements—e.g., logos, colors or other designs associated with the goods, etc.) is used to hide the pallets or other structures to provide a nice looking display.

One known skirt that has been utilized by such stores is referred to as a butterfly skirt. In this embodiment, graphic skirt panels (connected to a bottom mat or tray) are folded up around the product during shipping (i.e., forming a box-like structure around the product). When the pallet carrying the product is placed on one more additional pallets, the skirt panels are folded down and fixed at the corners with locking tabs or tape. The graphics appear on the exposed side of the panels. This requires a certain amount of labor (and additional materials when tape is used) to set properly set up.

Another known skirt, referred to as a false bottom pallet skirt, includes a skirt positioned around interior support partitions or structure (typically formed from corrugated paper or similar material). The display ships with trays of product on top of the partitions in the skirt and moved directly onto the floor for display at the store. This type of display provides a larger unit for shipping and requires more material, both of which increase the cost of the display.

The present invention provides a skirt that is easily assembled and reduces the cost of the display.

SUMMARY OF THE INVENTION

The present invention provides a skirt that interacts with a bottom, support pad for displaying goods on a stack of pallets. The skirt and support pad include a locking mechanism to enable positioning of the skirt around the stack of pallets. In one aspect, the support pad includes one or more upwardly extending projections or flanges that interact with a top portion of the skirt. The top portion of the skirt can include one or more interior rollover portions or pockets that catch the projections or flanges on the pad. The pad and skirt can include a flange/pocket combination on one or more sides.

In accordance with one aspect of the invention, a skirt system for use with displaying goods in a store is provided. The skirt system comprises a generally rectangular support pad that can be positioned on top of a pallet support surface. The support pad includes a first upwardly directed flange connected along a first side of the pad. The system also includes a skirt having four sides. The sides form a first rectangular opening at a top portion and a second rectangular opening at a bottom portion when the skirt is opened. The skirt also includes a first internally formed pocket at a top portion of a first side of the skirt. The first pocket is positioned to engage the first flange when the skirt is positioned over goods supported on the pad.

The support pad can also include a second flange extending upward along a second side of the support pad. The skirt can then include a second internally formed pocket at a top portion of a second side of the skirt. A third and fourth flange/pocket combination can also be provided.

The skirt can be formed from corrugated paper or corrugated plastic or other similar materials. Additionally, the skirt can include graphic on the outwardly facing sides of the skirt.

The skirt can be formed from a single blank of material or two or more separate pieces. The support pad can be formed from single blank of material.

In one aspect of the invention, the skirt is formed from four blanks of material. Each of the four blanks of material includes an edge panel for connecting the blank to another of the four blanks.

Opposing side walls of the skirt can each include a centrally located fold line. This allows the skirt to collapse to a flat state for shipment.

In accordance with another aspect of the invention, a skirt system for use with one or more pallets to form a display is provided. The system includes a generally rectangular support pad that can be positioned on top of a pallet support surface, a skirt having four sides forming a first rectangular opening at a top portion and a second rectangular opening at a bottom portion; and, a locking mechanism for securing a top edge of the skirt to the support pad.

The locking mechanism can include a first upwardly extending flange on a first side of the support pad and a second upwardly extending flange on a second side of the support pad. The locking mechanism can further include a first pocket on a first side of the skirt for engaging the first flange on the support pad and a second pocket on a second side of the skirt for engaging the second flange on the support pad.

A first side of the skirt can include a centrally located fold line and a second side of the skirt directly opposing the first side of the skirt can include a centrally located fold line. This enables the skirt to fold flat for easy transport.

Each of the four sides of the skirt can be formed from a side separate panel. The separate side panels can include an edge panel (along one side of the side panel) that is glued to another of the separate panels. In this manner, the side panels can form a chain, each linked by an edge panel to the next. Alternatively, opposing side panels could be provided with two edge panels (one on either side of the side panel) to connect to two adjacent side panels.

The first pocket can be formed from a top edge portion of the first side folded downward. Similarly, the second pocket can be formed from a top edge portion of the second side wall folded downward. Tape, glue or other suitable structures can be used proximate the sides of the folded over edge portions to secure them to the main portion of the side panel to form a pocket.

Additional aspects of the invention are described herein and shown in the Figures and Attachments.

BRIEF DESCRIPTION OF THE DRAWINGS

To understand the present invention, it will now be described by way of example, with reference to the accompanying drawings in which.

DETAILED DESCRIPTION

Figure 1:
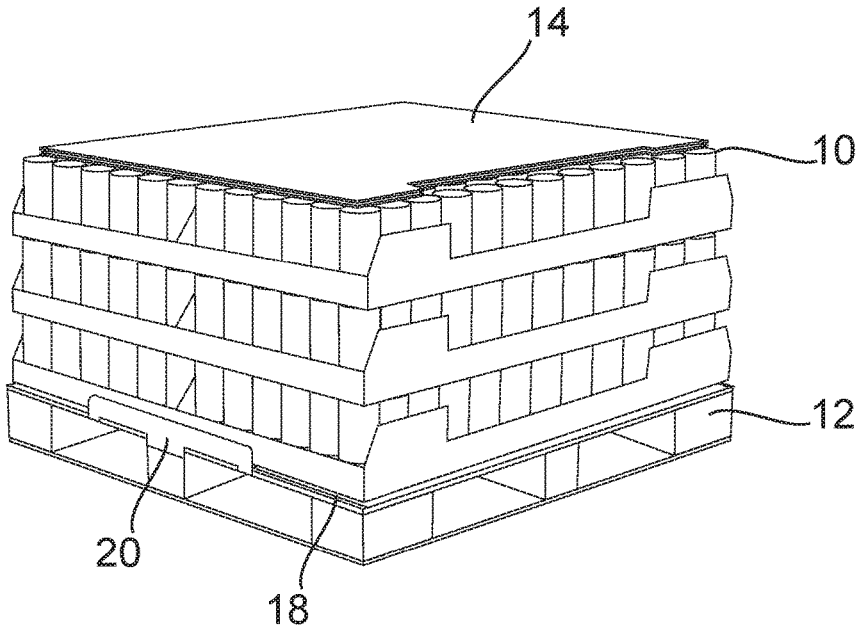
FIG. 1 is a perspective view of goods shipped with a pallet skirt in accordance with aspects of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is used for product or goods 10 that are shipped on a pallet 12 and then placed directly on the floor of a retail outlet or store for sale. The pallet 12 includes a generally rectangular upper support surface and includes lower openings designed to receive the tines of a forklift or similar apparatus. The pallet 12 is typically stacked on one or more additional pallets or other similar structure so that the product is at a proper height for display. The invention is used to cover the pallets and improve the look of the display.

FIG. 1 shows a skirt 14 folded and resting on goods 10 supported by a pallet 12. The goods are typically shipped in this configuration. The whole system can be wrapped in plastic or some other material for shipping.

Figure 2:
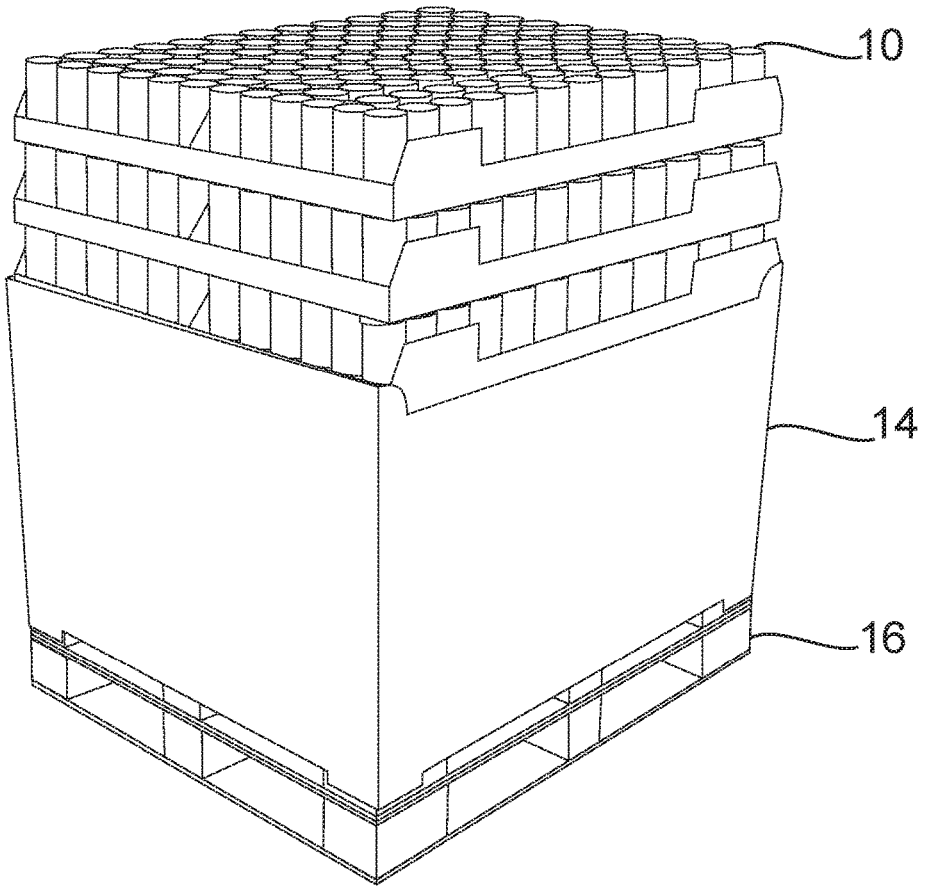
FIG. 2 is a perspective view of goods on a stack of pallets with a pallet skirt of the present invention.

FIG. 2 shows the pallet 12 and goods 10 positioned on additional pallets 16 with the skirt 14 covering all but the lowermost pallet 16 in the stack. The skirt 14 includes graphics related to the goods 10 being displayed.

Figure 3:
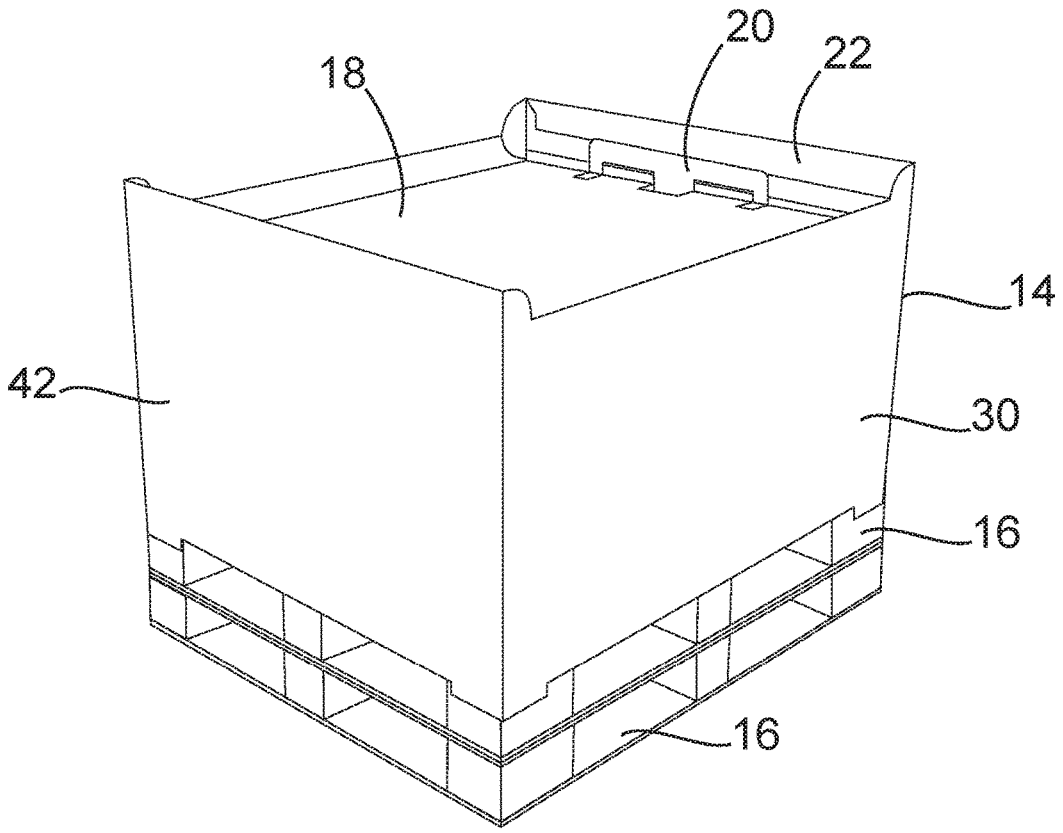
FIG. 3 is a perspective view of a stack of pallets with a pallet skirt in accordance with the present invention with the goods removed.

FIG. 3 shows a lower support pad or tray 18 that sits on the pallet 12 below the goods 10. The support pad 18 and skirt 14 include a locking mechanism to secure the skirt 14 to the pad 18. As illustrated in FIGS. 1-3, the support pad 18 includes one or more upward projections or flanges 20 on one or more sides of the pad 18. The flanges 20 cooperate with internally rolled over portions or pockets 22 at the top interior portion of the skirt 14.

In operation, the skirt 14 is opened or unfolded when the goods 12 and pallet 10 are placed on the additional pallets 16 at the store. The skirt 14 includes a rectangular opening at the top portion and a rectangular opening at a bottom portion. After it is opened, the skirt 14 is then slid over the goods 12 downward until the flanges 20 in the pad 18 engage the pockets 22 in the skirt 14.

Figure 4:
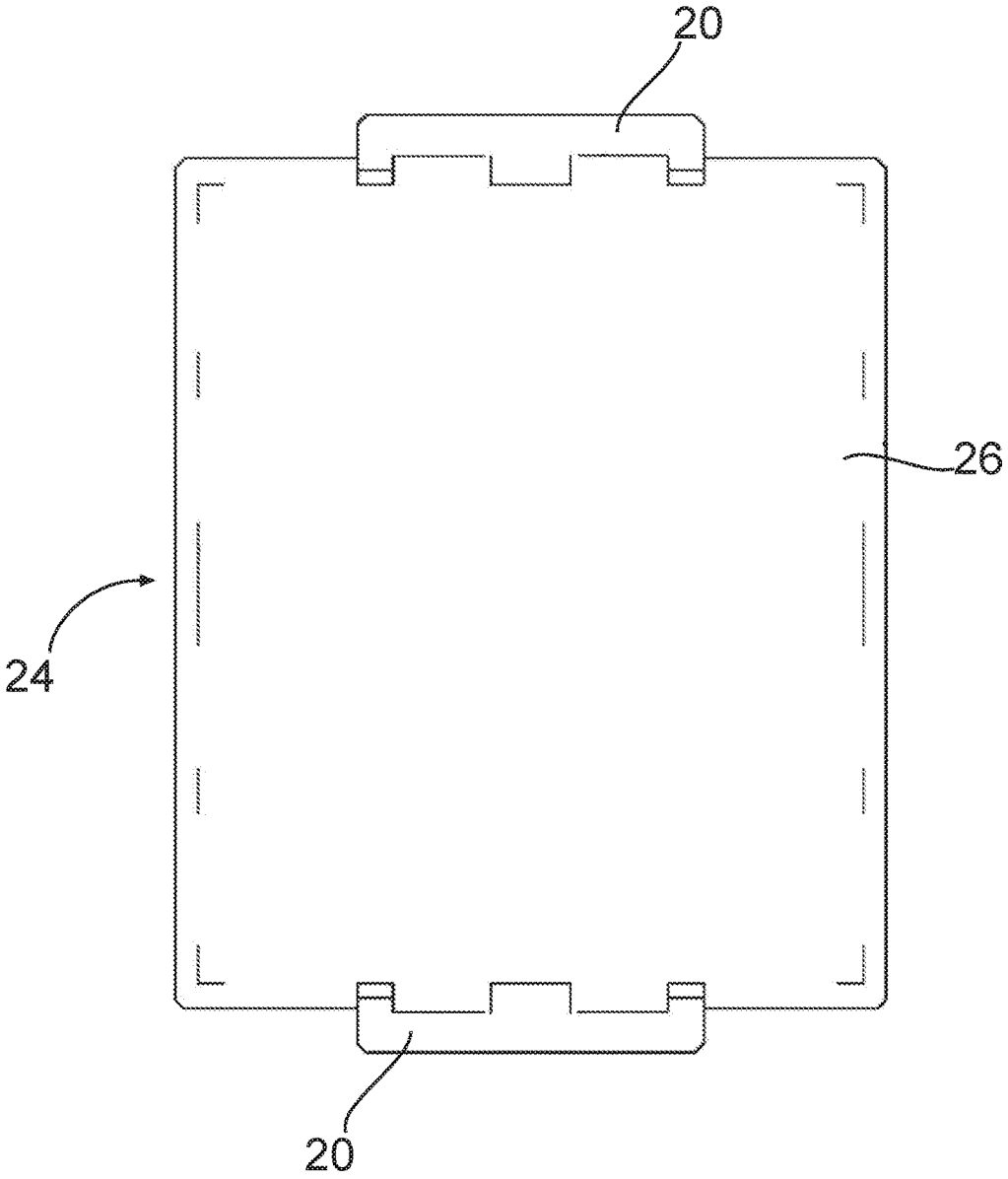
FIG. 4 is a plan view of a blank of material for forming a lower pad for use with the pallet skirt of the present invention.

A blank 24 for forming the pad 18 is shown in FIG. 4. The blank 24 includes a central, rectangular portion 26 that coincides with the upper surface of the pallet 12. The blank 24 includes a first flange 20 on one side of the central portion 26 and a second flange 20 on an opposing second side of the central portion 26. The flanges 20 are folded or bent upwards to form the pad 18. The flanges 20 and central portion 26 can be integrally formed from a single die cut piece of material. Alternatively, the flanges 20 can be separate pieces that are secured to the central portion 26 (e.g., by glue or other conventional means).

Figure 5:
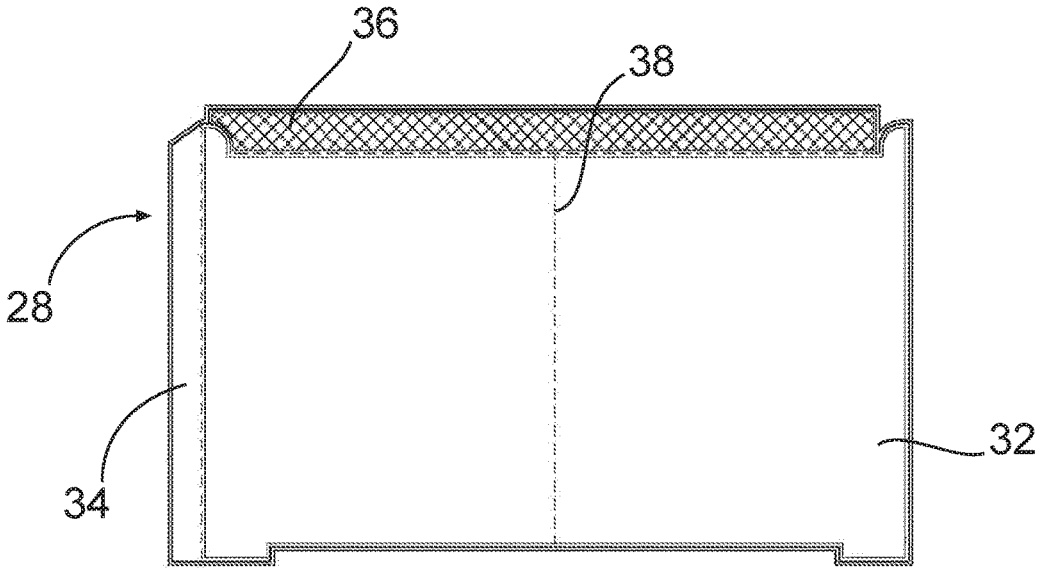
FIG. 5 is a plan view of a blank for forming a foldable side walls of a pallet skirt in accordance with the present invention.

FIG. 5 shows a plan view of a blank 28 that is used to form a side wall 30 of the skirt 14 that does not engage a flange 20. The blank 28 includes a central, rectangular wall portion 32, an edge panel 34 along one side (for attachment of the blank 28 to another wall of the skirt 14) and a top flap 36 that is glued to an inner surface of the blank 28 (the cross-hatching represents areas for glue, or other securing means). The blank 28 includes a centrally located fold line 38 which enables the skirt 14 to collapse to a flat configuration for easy, efficient transport.

Figure 6:
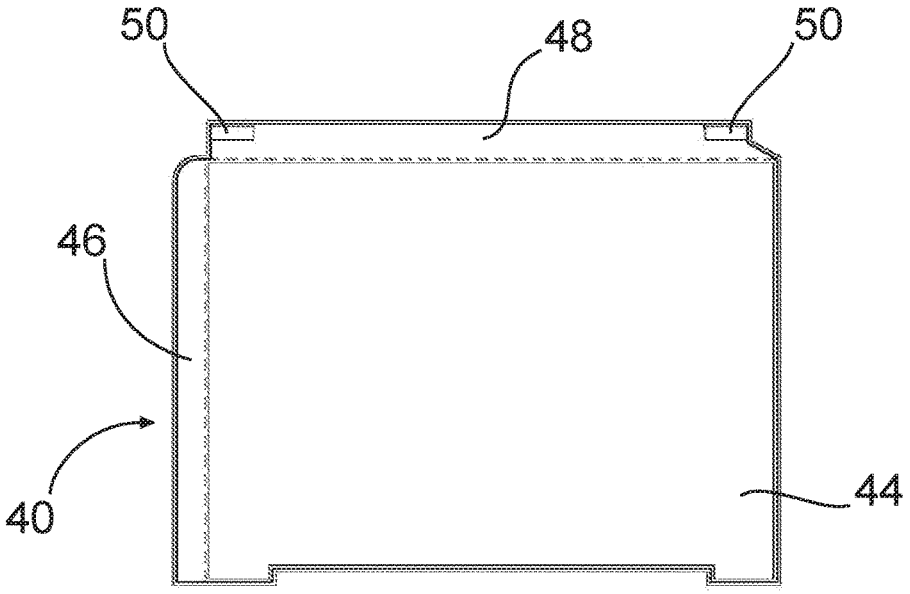
FIG. 6 is a plan view of a blank for forming additional side walls of the pallet skirt in accordance with the present invention; and, FIG. 7 is a schematic drawing illustrating setting up a pallet skirt in accordance with the present invention.

FIG. 6 discloses a plan view of a blank 40 that is used to form a side wall 42 of the skirt 14 for engaging a flange 20 of the pad 18. The blank 40 includes a central, rectangular wall portion 44, an edge panel 46 along one side (for attachment of the blank 40 to another wall of the skirt) and a top flap 48 for forming the pocket 22 for engaging the flange 20 of the pad 18. The top flap 48 includes two pieces of thick foam tape 50 at either end of the flap 48 for securing the flap 48 to the interior side of the central portion 44 of the blank 40.

Using the edge panels 34, 40, the side walls 30, 40 are connected to form a four panel skirt 14 having opposing flange engaging side walls 42 connected to opposing non-flange engaging side walls 30. While each wall includes a single edge panel, alternating walls can be formed with two edge panels (one on either side) and alternate walls can be formed without edge panels.

Figure 7:
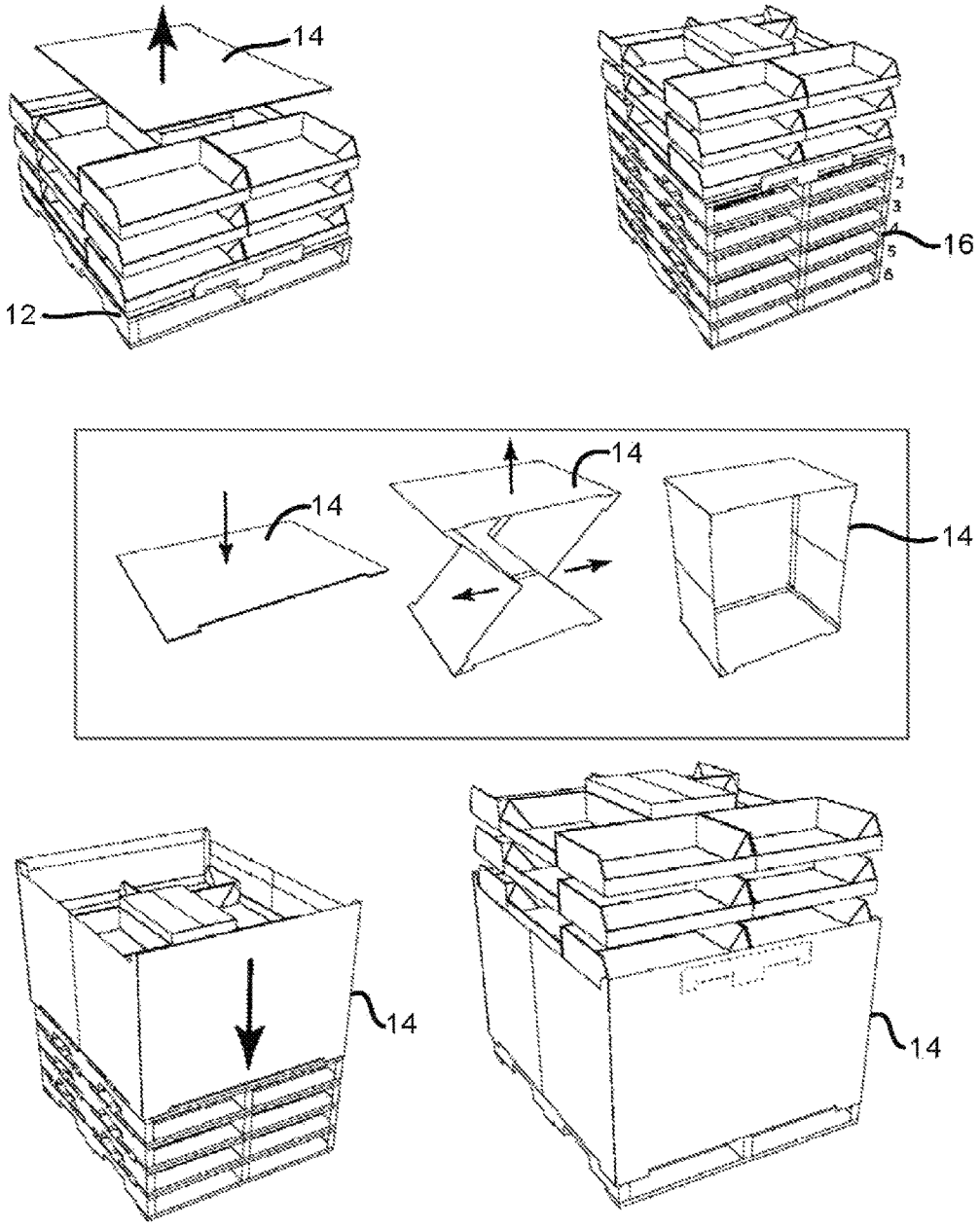

FIG. 7 illustrates use and set up of the pallet skirt with a pallet containing goods. As shown, the pallet skirt is collapsed and shipped with the goods. To use, the skirt 14 is opened and then positioned over the goods and moved downward until the pockets 22 engage the flanges 20.

While the skirt 14 and pad 18 are shown with two flange/pocket combinations on opposing walls, fewer or more flange/pocket combinations can be used (e.g., only one wall, or on three or more walls). Similarly, while a single flange and pocket is shown for a wall, more than one flange and more than one pocket can be used on a wall (or multiple flanges with a single, long pocket).

In accordance with one embodiment, the skirt 14 is formed from a single blank of material to include fold lines creating four sides. The two ends of the blank are glued or otherwise secured to each other so that opening the skirt 14 forms the rectangular openings defined by the sides.

Similarly, the pad 18 can be formed from a single blank of material. The one or more flanges 20 can be folded upward from the sides of the pad 18.

The skirt 14 and pad 18 can be formed from paper or plastic, such as a solid or corrugated paper or plastic, or other similar materials. The graphics can include any design, color or indicia, or combination thereof, to suitably be used to enhance the visual aspect of the display and/or the sale of the goods thereon.

The skirt and pad are shown locking together when set up. In alternative aspects of the invention, the skirt can include a flange that engages a pocket on the pad. Additionally, other locking mechanisms or configurations can be utilized to connect the skirt to the pad.

Many modifications and variations of the present invention are possible in light of the above teachings. It is, therefore, to be understood within the scope of the appended claims the invention may be protected otherwise than as specifically described.

We claim:

1. A skirt system for use with displaying goods in a store comprising:

a generally rectangular support pad that can be positioned on top of a pallet support surface, the support pad including a first upwardly directed flange connected along a first side of the pad;

a skirt having four sides forming a first rectangular opening at a top portion and a second rectangular opening at a bottom portion, the skirt including a first internally formed pocket at a top portion of a first side of the skirt, wherein the first internally formed pocket includes a downwardly facing opening formed between an inner surface of the first side of the skirt and a sheet of material connected to the first side of the skirt and wherein the downwardly facing opening of the first pocket is positioned to engage the first flange on the support pad.

2. The skirt system of claim 1 wherein the support pad includes a second flange extending upward along a second side of the support pad, and the skirt includes a second internally formed pocket at a top portion of a second side of the skirt, wherein the second internally formed pocket includes a downwardly facing opening formed between an inner surface of the second side of the skirt and a sheet of material connected to the second side of the skirt.

3. The skirt system of claim 1 wherein the skirt is formed from corrugated paper.

4. The skirt system of claim 1 wherein the skirt is formed from corrugated plastic.

5. The skirt system of claim 1 wherein the skirt includes graphics on the sides of the skirt.

6. The skirt system of claim 1 wherein the skirt is formed from four blanks of material.

7. The skirt system of claim 6 wherein each of the four blanks of material includes an edge panel for connecting the blank to another blank.

8. The skirt system of claim 6 wherein the support pad is formed from single blank of material.

9. The skirt system of claim 1 wherein opposing side walls of the skirt each include a central fold line to enable the skirt to collapse to a flat state.

10. A skirt system for use with one or more pallets to form a display a generally rectangular support pad having a first side, an opposing second side that is parallel to the first side, a third side and an opposing fourth side that is parallel to the third side wherein the third and fourth sides are perpendicular to the first and second sides, a planar support surface that extends between the first side of the support pad to the opposing second side of the support pad and between the third side of the support pad to the opposing fourth side, wherein the support pad can be positioned on top of a pallet support surface, a skirt having four sides forming a first rectangular opening at a top portion and a second rectangular opening at a bottom portion; and, a locking mechanism for securing a top edge of the skirt to the support pad wherein the locking mechanism includes a first upwardly extending flange on a first side of the support pad and a second upwardly extending flange on a second side of the support pad.

11. The skirt system of claim 10 wherein the locking mechanism includes a first pocket on a first side of the skirt for engaging the first flange on the support pad and a second pocket on a second side of the skirt for engaging the second flange on the support pad.

12. The skirt of claim 11 wherein the first pocket is formed from a top edge portion of the first side folded downward and the second pocket is formed from a top edge portion of the second side wall folded downward.

13. The skirt system of claim 10 wherein a first side of the skirt includes a centrally located fold line and a second side of the skirt directly opposing the first side of the skirt includes a centrally located fold line.

14. The skirt of claim 10 wherein each of the four sides of the skirt is formed from a separate panel.

15. The skirt of claim 14 wherein each of the separate panels includes an edge panel that is glued to another of the separate panels.

16. The skirt of claim 10 wherein the skirt includes graphics on the sides of the skirt.

17. The skirt of claim 10 wherein the top pad is formed from a single blank of material.

18. The skirt of claim 10 wherein the pad and the skirt are formed from a paper corrugated material.

19. The skirt of claim 10 wherein the pad and the skirt are formed from a plastic corrugated material.

20. A skirt system for use with one or more pallets to form a display comprising:

a planar rectangular support pad having a first side, a second side, a third side and a fourth side, the support pad including a first upwardly extending projection foldably connected to the first side; and, a skirt having a first wall, a second wall, a third wall and a fourth wall, a bottom rectangular opening and a top rectangular opening, the first side wall of the skirt including a first internal downwardly extending projection foldably connected to a top edge of the first side wall to form a first pocket with an interior surface of the first side wall, wherein the first pocket is positioned to engage the first upwardly extending projection of the support pad.

21. The skirt of claim 20 further comprising a second upwardly projection extension foldably connected to the second side of the support pad, and a second internal downwardly extending projection foldably connected to a top edge of the second side wall of the skirt to form a second pocket with an interior surface of the second side wall, wherein the second pocket is positioned to engage the second upwardly extending projection of the support pad.

* * * * *